United States Patent [19]

Olszewski et al.

[11] 4,439,220

[45] Mar. 27, 1984

[54] DUAL COLUMN HIGH PRESSURE NITROGEN PROCESS

[75] Inventors: Walter J. Olszewski, Tonawanda; Ravindra F. Pahade, North Tonawanda; John H. Ziemer, Grand Island, all of N.Y.

[73] Assignee: Union Carbide Corporation, Danbury, Conn.

[21] Appl. No.: 446,235

[22] Filed: Dec. 2, 1982

[51] Int. Cl.[3] ..... F25J 3/04

[52] U.S. Cl. ..... 62/31; 62/34

[58] Field of Search ..... 62/12, 13, 23, 24, 27-32, 62/34, 38, 39, 42, 43

[56] References Cited

U.S. PATENT DOCUMENTS

| | | | |
|---|---|---|---|
| 2,873,583 | 2/1959 | Potts et al. | 62/14 |
| 3,203,193 | 8/1965 | Ruhemann et al. | 62/13 |
| 3,210,947 | 10/1965 | Dubs et al. | 62/13 |
| 3,217,502 | 11/1965 | Keith, Jr. | 62/13 |
| 3,270,514 | 9/1966 | Kamlani | 62/29 |
| 3,348,385 | 10/1967 | Kamlani et al. | 62/29 |
| 3,375,673 | 4/1968 | Cimler et al. | 62/13 |
| 3,447,331 | 6/1969 | Smith | 62/13 |
| 3,736,762 | 6/1973 | Toyama et al. | 62/13 |
| 4,222,756 | 9/1980 | Thorogood | 62/13 |

*Primary Examiner*—Frank Sever

*Attorney, Agent, or Firm*—Stanley Ktorides

[57] ABSTRACT

A process to efficiently produce large quantities of elevated pressure nitrogen at a high recovery by the cryogenic separation of air employing two separate columns each of which is equipped with a top condenser and wherein the second column processes a feed stream obtained from the first column.

17 Claims, 3 Drawing Figures

DUAL COLUMN HIGH PRESSURE NITROGEN PROCESS

TECHNICAL FIELD

This invention relates generally to the field of cryogenic separation of air and more particularly to the field of cryogenic separation of air to produce nitrogen.

BACKGROUND ART

A use of nitrogen which is becoming increasingly more important is as a fluid for use in secondary oil or gas recovery techniques. In such techniques a fluid is pumped into the ground to facilitate the removal of oil or gas from the ground. Nitrogen is often the fluid employed because it is relatively abundant and because it does not support combustion.

When nitrogen is employed in such enhanced oil or gas recovery techniques it is generally pumped into the ground at an elevated pressure which may be from 500 to 10,000 psia or more.

The production of nitrogen by the cryogenic separation of air is well known. One well known process employs two columns in heat exchange relation. One column is at a higher pressure in which the air is preseparated into oxygen-enriched and nitrogen-rich fractions. The other column is at a lower pressure in which the final separation of the air into product is carried out. Such a double column process efficiently carries out the air separation and can recover a high percentage, up to about 90 percent, of the nitrogen in the feed. However such a process has a drawback when the nitrogen is desired for use in enhanced oil or gas recovery because the product nitrogen is at a relatively low pressure, generally between about 15–25 psia. This necessitates a significant amount of further compression of the nitrogen before it can be utilized in enhanced oil or gas recovery operations. This further compression is quite costly.

Also known are single column cryogenic air separation processes which produce high pressure nitrogen typically at a pressure of from about 70 to 90 psia. Nitrogen at such higher pressure significantly reduces the cost of pressurizing the nitrogen to the level necessary for enhanced oil and gas recovery operations over the cost of pressurizing the nitrogen product of a conventional double column separation. However, such single column processes can recover only a relatively low percentage, up to about 60 percent, of the nitrogen in the feed air. Furthermore, if one carried out the separation in the column at a higher pressure in order to produce nitrogen at a higher pressure than 70–90 psia, one would experience an even lower recovery than the 60 percent referred to above.

It is therefore an object of this invention to provide a cryogenic air separation process which will produce nitrogen at an elevated pressure and at a high separation efficiency and at high recovery.

SUMMARY OF THE INVENTION

The above and other objects which will become obvious to one skilled in the art upon a reading of this disclosure are attained by:

A process for the production of nitrogen gas at greater than atmospheric pressure by the separation of air by rectification comprising:

(A) introducing cleaned, cooled feed air at greater than atmospheric pressure into a high pressure column operating at a pressure of from about 80 to 300 psia;

(B) separating said feed air by rectification in said high pressure column into a first nitrogen-rich vapor fraction and a first oxygen-enriched liquid fraction;

(C) recovering from about 20 to 60 percent of said first nitrogen-rich vapor fraction as high pressure nitrogen gas;

(D) condensing a portion of said first nitrogen-rich vapor fraction by indirect heat exchange with said first oxygen-enriched liquid fraction thereby producing a first nitrogen-rich liquid portion and a first oxygen-enriched vapor fraction;

(E) employing said first nitrogen-rich liquid portion as liquid reflux for said high pressure column;

(F) introducing said first oxygen-enriched vapor fraction into a medium pressure column operating at a pressure, lower than that of said high pressure column pressure, of from about 40 to 150 psia;

(G) separating said first oxygen-enriched vapor fraction by rectification in said medium pressure column into a second nitrogen-rich vapor fraction and a second oxygen-enriched liquid fraction;

(H) recovering from about 20 to 60 percent of said second nitrogen-rich vapor fraction as medium pressure nitrogen gas;

(I) condensing a portion of said second nitrogen-rich vapor fraction by indirect heat exchange with said second oxygen-enriched liquid fraction thereby producing a second nitrogen-rich liquid portion and a second oxygen-enriched vapor fraction;

(J) employing said second nitrogen-rich liquid portion as liquid reflux for said medium pressure column; and (K) removing from the process said second oxygen-enriched vapor fraction.

The term "indirect heat exchange," as used in the present specification and claims, means the bringing of two fluid streams into heat exchange relation without any physical contact or intermixing of the fluids with each other.

The term, "column," as used in the present specification and claims, means a distillation or fractionation column or zone, i.e., a contacting column or zone wherein liquid and vapor phases are countercurrently contacted to effect separation of a fluid mixture, as for example, by contacting of the vapor and liquid phases on a series of vertically spaced trays or plates mounted within the column or alternatively, on packing elements with which the column is filled. For a further discussion of distillation columns see the Chemical Engineers' Handbook, Fifth Edition, edited by R. H. Perry and C. H. Chilton, McGraw-Hill Book Company, New York Section 13, "Distillation" B. D. Smith et al, page 13-3, *The Continuous Distillation Process.* Vapor and liquid contacting separation processes depend on the difference in vapor pressures for the components. The high vapor pressure (or more volatile or low boiler) component will tend to concentrate in the vapor phase whereas the low vapor pressure (or less volatile or high boiler) will tend to concentrate in the liquid phase. Distillation is the separation process whereby heating of a liquid mixture can be used to concentrate the volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principle of rectification to separate mixtures are often interchangeably termed rectification columns, distillation columns, or fractionation columns.

The term "cleaned, cooled air" as used in the present specification and claims, means air which has been substantially cleaned of impurities such as water vapor and carbon dioxide and is at a temperature generally below about 120° K., preferably below about 110° K.

The term "reflux ratio" as used in the present specification and claims, means the numerical ratio of the liquid flow to the vapor flow, each expressed on a molal basis, that are countercurrently contacted within the column to effect separation.

DETAILED DESCRIPTION

The process of this invention will be described in detail with reference to the drawings.

Figure 1:
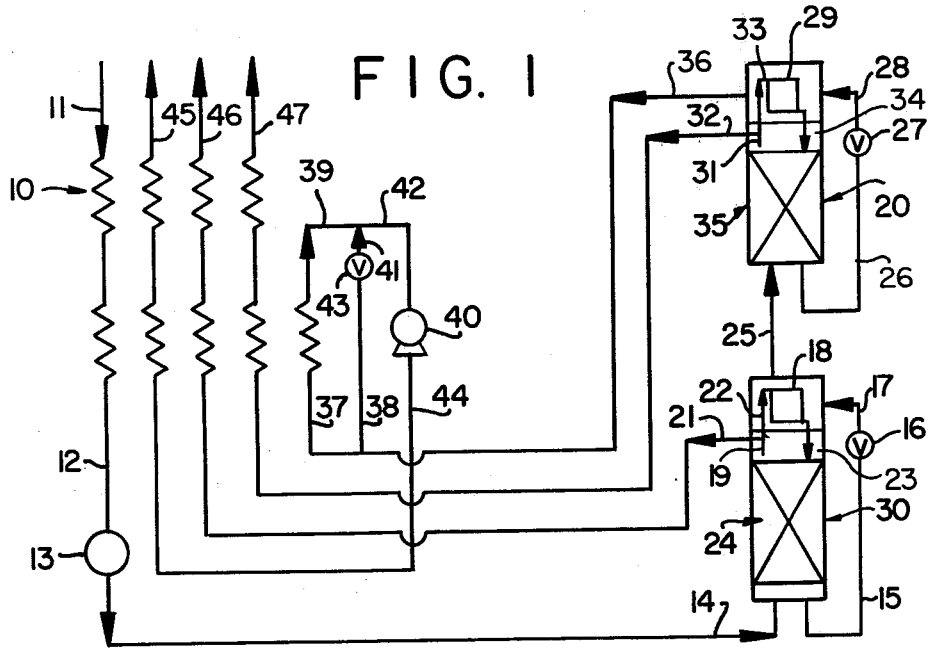
FIG. 1 is a schematic representation of one preferred embodiment of the process of this invention.

Referring now to FIG. 1, pressurized feed air 11 is passed through desuperheater 10 where it is cooled and cleaned of impurities such as water vapor and carbon dioxide. The cooled, clean air 12 is then passed through cold end adsorbent trap 13 wherein there are removed contaminants such as hydrocarbons and entrained solids. The cold end adsorbent trap 13 is composed of any suitable material such as, for example, silica gel.

The pressurized, cleaned, cooled air 14 is introduced into the bottom of high pressure column 30 operating at a pressure of from about 80 to 300 psia, preferably from about 90 to 200 psia, most preferably from about 100 to 160 psia. In column 30 the air is separated into a first nitrogen-rich vapor fraction and a first oxygen-enriched liquid fraction. The first nitrogen-rich vapor fraction 19 is divided into portion 21, which is removed from column 30, passed through desuperheater 10 and recovered as product high pressure nitrogen gas 46, and portion 22 which is introduced to condenser 18. Nitrogen-rich vapor portion 21 may comprise from about 20 to 60 percent of first nitrogen-rich vapor fraction 19, preferably from about 30 to 50 percent, most preferably from about 35 to 45 percent. The first oxygen-enriched liquid fraction 15 is expanded in valve 16 and passed 17 to condenser 18 where it is vaporized by indirect heat exchange with nitrogen-rich vapor portion 22 thereby producing a first oxygen-enriched vapor fraction and a first nitrogen-rich liquid portion 23. The first nitrogen-rich liquid portion 23 is employed as liquid reflux against feed air 14 in column section 24 to effect the separation of the feed air.

Oxygen-enriched stream 25 is introduced to the bottom of column 20 as feed. Stream 25 may be entirely vapor or may be up to about 5 percent liquid. Column 20 operates at a pressure, lower than column 30, from about 40 to 150 psia, preferably from about 45 to 100 psia, most preferably from about 50 to 80 psia.

In column 20 the oxygen-enriched stream 25 is separated into a second nitrogen-rich vapor fraction and a second oxygen-enriched liquid fraction. The second nitrogen-rich vapor fraction 31 is divided into portion 32 which is removed from column 30, passed through desuperheater 10 and recovered as product medium pressure nitrogen gas 47, and portion 33 which is introduced to condenser 29. Nitrogen-rich vapor portion 32 may comprise from about 20 to 60 percent of second nitrogen-rich vapor fraction 31, preferably from about 30 to 50 percent, most preferably from about 35 to 45 percent. The second oxygen-enriched liquid fraction 26 is expanded in valve 27 and passed 28 to condenser 29 where it is vaporized by indirect heat exchange with nitrogen-rich vapor portion 33. As is the case with expansion in valve 16, the oxygen-enriched liquid expansion in valve 27 is carried out to develop a pressure differential and hence a temperature differential so that the higher pressure nitrogen-rich vapor can be condensed against the lower-pressure oxygen-enriched liquid. The resulting second nitrogen-rich liquid portion 34 is employed as liquid reflux against oxygen-enriched vapor in column section 35 to effect the separation.

The second oxygen-enriched vapor fraction 36 resulting from the condensation of nitrogen-rich vapor portion 33 may be passed through desuperheater 10 and removed from the process. The embodiment of FIG. 1 illustrates a preferred embodiment wherein this waste stream 36 maintains some pressure energy and is employed to develop plant refrigeration. In this preferred embodiment, oxygen-enriched waste stream 36 is divided in fractions 37 and 38. Fraction 37 is introduced into air desuperheater 10 and is partially warmed. This stream serves to provide cold end unbalance for temperature control to ensure self-cleaning of the reversing heat exchanger. Reversing heat exchangers and their self-cleaning requirements are well known in the art. The unbalance stream is removed from the desuperheater as stream 39. Stream 38 is expanded in valve 43 and is passed as stream 41 to stream 39 with which it combines to form stream 42. This stream 42, which is still at pressure is expanded in turboexpander 40 from which it emerges as stream 44 which is passed to desuperheater 10, warmed to ambient temperature and removed from the system as stream 45. The use of the waste oxygen-enriched stream to provide plant refrigeration is advantageous because the columns now operate at higher pressures than is the case when the oxygen-enriched stream is merely passed through the desuperheater. This results in higher pressure nitrogen product. This advantage is present whether reversing or primary heat exchangers are used as the desuperheater. When reversing heat exchangers are used, another advantage is increased product nitrogen recovery due to the higher pressure of the incoming feed air.

Table I contains typical process conditions obtained from a computer simultion of the process as illustrated in FIG. 1. The stream numbers refer to the numerals in FIG. 1. The abbreviation, mcfh, as used in Tables I and II, means thousand cubic feet per hour at standard conditions. As shown in Table I the nitrogen recovery was 79 percent of that available from the feed air.

TABLE I

| Stream | Number | Value |
|---|---|---|
| Feed Air | | |
| Flow, mcfh | 11 | 960 |
| Temperature, degrees K. | | 278 |
| Pressure, psia | | 130 |
| High Pressure Column Feed Air | | |
| Flow, mcfh | 14 | 960 |
| Pressure, psia | | 127 |
| Medium Pressure Column Feed | | |
| Flow, mcfh | 25 | 581 |
| Purity, percent $O_2$ | | 35 |
| Pressure, psia | | 69 |
| Waste Oxygen - Enriched Vapor | | |
| Flow, mcfh | 36 | 360 |
| Purity, percent $O_2$ | | 56 |
| Pressure, psia | | 25 |
| High Pressure Nitrogen Product | | |
| Flow, mcfh | 21 | 379 |
| Purity, ppm $O_2$ | | 4 |
| Pressure, psia | | 124 |
| Medium Pressure Nitrogen Product | | |
| Flow, mcfh | 32 | 221 |
| Purity, ppm $O_2$ | | 4 |
| Pressure, psia | | 67 |
| Nitrogen Recovery, percent | | 79 |

Figure 2:
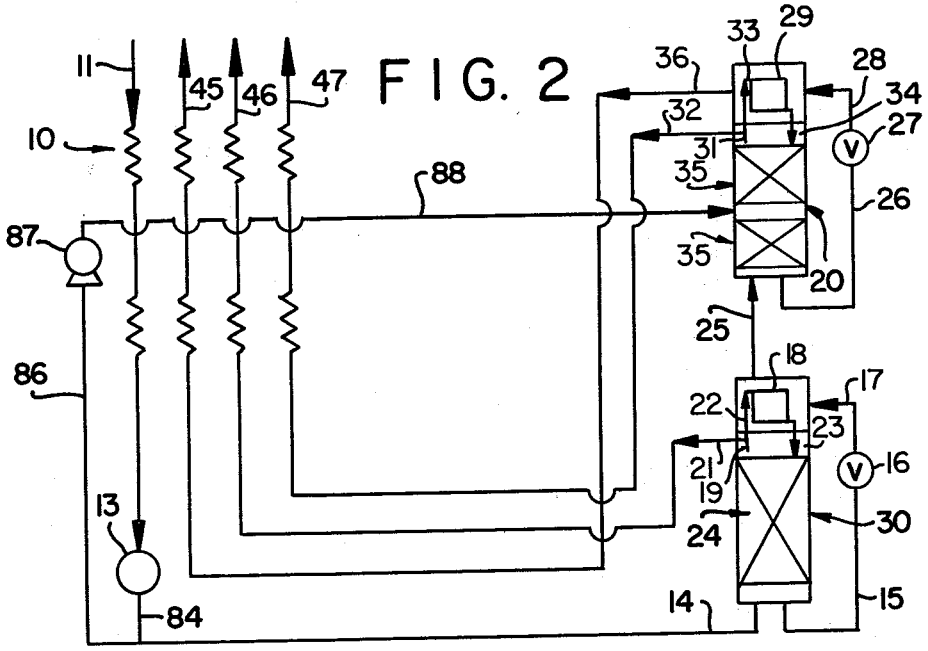
FIG. 2 is a schematic representation of another preferred embodiment of the process of this invention.

FIG. 2 illustrates another preferred embodiment of the process of this invention wherein a feed air fraction is employed for reversing heat exchanger temperature control and for plant refrigeration. Since the air desuperheater utilizes an air fraction for both temperature control and plant refrigeration rather than an oxygen-rich stream, this embodiment can have some plant reliability advantages. Furthermore, this process arrangement can utilize feed air at lower pressures because, since the waste oxygen stream from the medium pressure column is not expanded for plant refrigeration, it can therefore be at a lower pressure. The numerals used in FIG. 2 correspond to those of FIG. 1 for the elements common to both.

Referring now to FIG. 2, pressurized, cleaned and cooled feed air at 84 is divided into portion 14, which is fed into column 30, and into portion 86 which may comprise from about 10 to 30 percent of the feed air. Stream 86 is warmed by partial traverse of desuperheater 10 and expanded in turboexpander 87 to a medium pressure. The medium pressure air is then introduced 88 into medium pressure column 20 wherein it is separated by rectification into nitrogen-rich vapor and oxygen-enriched liquid which, in part, comprise the second nitrogen-rich vapor fraction and the second oxygen-enriched liquid fraction, respectively. The remainder of the process is similar to that described in the discussion of the FIG. 1 embodiment.

Table II contains typical process conditions obtained from a computer simulation of the process as illustrated in FIG. 2. The stream numbers refer to the numerals of FIG. 2. In the process tabulated in Table II, the nitrogen recovery was 80 percent of that available from the feed air.

TABLE II

| Stream | Number | Value |
|---|---|---|
| Feed Air | | |
| Flow, mcfh | 11 | 2682 |
| Temperature, degrees K. | | 278 |
| Pressure, psia | | 107 |
| High Pressure Column Feed Air | | |
| Flow, mcfh | 14 | 2266 |
| Pressure, psia | | 105 |

TABLE II-continued

| Stream | Number | Value |
|---|---|---|
| Medium Pressure Column Feed Air | | |
| Flow, mcfh | 88 | 416 |
| Pressure, psia | | 54 |
| Medium Pressure Column Feed | | |
| Flow, mcfh | 25 | 1322 |
| Purity, percent $O_2$ | | 36 |
| Waste Oxygen - Enriched Vapor | | |
| Flow, mcfh | 36 | 979 |
| Pressure, psia | | 18 |
| Purity, percent $O_2$ | | 58 |
| High Pressure Nitrogen Product | | |
| Flow, mcfh | 21 | 944 |
| Pressure, psia | | 102 |
| Purity, ppm $O_2$ | | 4 |
| Medium Pressure Nitrogen Product | | |
| Flow, mcfh | 32 | 760 |
| Pressure, psia | | 52 |
| Purity, ppm $O_2$ | | 4 |
| Nitrogen Recovery, percent | | 80 |

Figure 3:
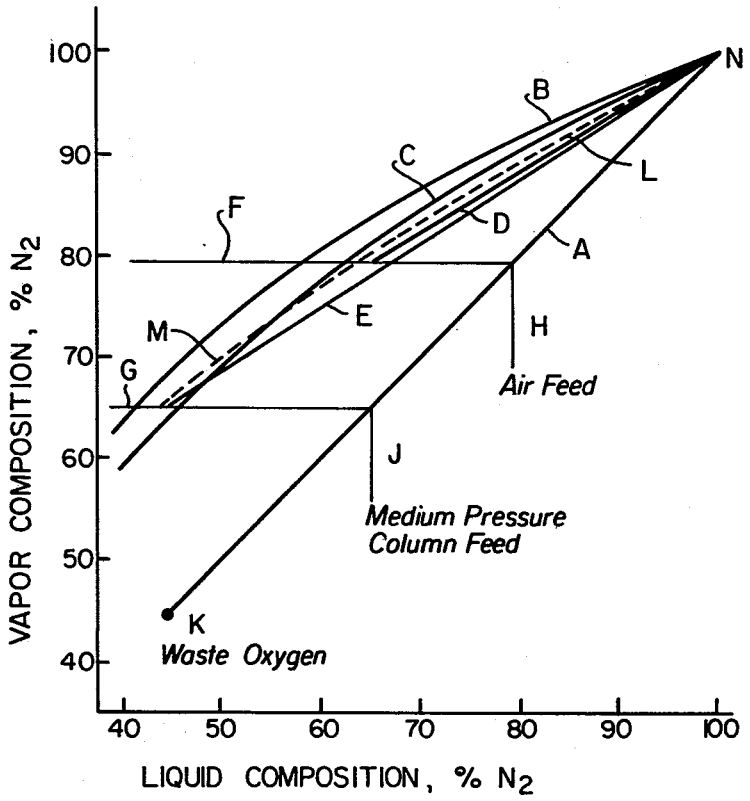
FIG. 3 is a McCabe-Thiele diagram for two distillation columns useful in the process of this invention.

The process of this invention produces unexpectedly beneficial results by employing two separation columns at specified pressure levels and having a requisite feed composition relationship. To more clearly explain the unexpected nature of the benefits of the process of this invention, reference is made to FIG. 3 which is a McCabe-Thiele diagram for distillation columns useful in the process of this invention. See, for example, *Unit Operations of Chemical Engineering*, McCabe and Smith, McGraw Hill Book Company, New York, 1956, Chapter 12, pages 689–708 for a discussion of McCabe-Thiele diagrams. In FIG. 3 air is approximated as a binary system comprising nitrogen and oxygen with argon and other gases being represented as oxygen.

Referring now to FIG. 3, line A is the locus of equal vapor and liquid compositions. Curve C is the equilibrium curve of the high pressure column and shows the locus of equilibrium vapor compositions for liquid compositions throughout the column, and in similar fashion, Curve B is the locus of equilibrium conditions for the medium pressure column. The high pressure column would handle an air feed H in the substantially saturated vapor condition as represented by feed line F. Line D shows the representative liquid-to-vapor reflux ratio for the column and is thereby the locus of mass balance vapor and liquid compositions throughout the column. As can be seen from FIG. 3, the medium pressure column feed at a composition at J of about 35 percent oxygen is taken from the bottom of the high pressure column, and after it is vaporized, it becomes the saturated vapor feed to the medium pressure column, represented by horizontal feed line G. Line E represents the liquid-to-vapor ratio locus of the medium pressure column, and as can be seen, that liquid-to-vapor or reflux ratio is only slightly higher than the reflux ratio of the high pressure column, represented by line D. Thus it is seen that it is fortuitous that the equilibrium line B for the medium pressure column has a higher nitrogen content vapor at any given liquid condition or else the reflux ratio shown would be insufficient for the medium pressure column to be operative. In other words, the medium pressure column is at a pressure which allows it to handle a higher oxygen content feed at a reflux ratio comparable to that which is necessary in the high pressure column. As a result, the medium pressure column can have nitrogen product recovery comparable to that of the high pressure column, in spite of the higher oxygen content feed to the medium pressure column. This is because the lower operating pressure level of the medium pressure column compensates for the higher oxygen content feed. If a significantly higher reflux ratio were required for the medium pressure column, this would have to be obtained by reducing the nitrogen product from that column and thereby reducing the nitrogen product recovery from the feed to that medium pressure column. The process of this invention results in the combination of different feed streams to separate columns operating at different pressures such that each column produces nitrogen product, represented by point N, at an effective recovery.

An advantage of the embodiment of FIG. 2 can be illustrated by the position of lines L and M which represent the reflux ratios for the two sections of the medium pressure column. The addition of some vapor air feed to the medium pressure column allows a higher reflux ratio in the bottom section and therefore allows a lower reflux ratio in the top section of the medium pressure column while not hindering operability.

The product of the process of this invention is nitrogen at elevated pressure. Generally the nitrogen will be recovered at a purity of at least 99 mole percent. Non-oxygen gases such as argon are included in the purity calculations as nitrogen. Preferably the nitrogen is recovered at a purity of at least 99.5 percent, most preferably at least 99.9 percent. Furthermore, some nitrogen, up to about 5 percent of the product, may be recovered as liquid if some of reflux stream 23 and/or reflux stream 34 is not required to obtain the desired reflux ratio in the appropriate column.

In another process variation either or both oxygen-enriched liquid streams 15 and 26 from the columns may be sub-cooled against the oxygen waste stream and/or the product nitrogen streams. This may improve the efficiency of the process.

In yet another process variation, some feed air may be used to superheat the waste and product streams and the resulting condensed feed air, which may be from about 1 to 3 percent of the total feed, could be introduced to either column at an intermediate point.

In still another process variation, the waste oxygen-enriched stream 36 may be retained at pressure and the high pressure nitrogen product may be expanded to medium pressure to generate plant refrigeration.

In a further process variation, the air desuperheater can utilize non-reversing or primary heat exchangers to cool the feed air versus the return streams. Such a process arrangement could utilize the well known technique of warm-end or ambient temperature adsorptive cleanup of the feed air. Plant refrigeration could still be generated by air, product nitrogen, or waste oxygen expansion.

Furthermore, as is easily recognized, one can, if desired, recover the waste oxygen streams as lower purity oxygen product.

By the use of the process of this invention one can efficiently produce large quantities of nitrogen at high pressure and at high recovery. Although the process has been described in detail with reference to specific embodiments, those skilled in the art will recognize that there are many other embodiments which are encompassed by the spirit and scope of the claimed process.

We claim:

1. A process for the production of nitrogen gas at greater than atmospheric pressure by the separation of air by rectification comprising:

(A) introducing cleaned, cooled feed air at greater than atmospheric pressure into a high pressure column having a top condenser, and operating at a pressure of from about 80 to 300 psia;

(B) separating said feed air by rectification in said high pressure column into a first nitrogen-rich vapor fraction and a first oxygen-enriched liquid fraction;

(C) recovering from about 20 to 60 percent of said first nitrogen-rich vapor fraction as high pressure nitrogen gas at a pressure of from about 80 to 300 psia and a purity of at least 99 mole percent;

(D) condensing a portion of said first nitrogen-rich vapor fraction by indirect heat exchange with said first oxygen-enriched liquid fraction thereby producing a first nitrogen-rich liquid portion and a first oxygen-enriched vapor fraction;

(E) employing said first nitrogen-rich liquid portion as liquid reflux for said high pressure column;

(F) introducing said first oxygen-enriched vapor fraction into a medium pressure column having a top condenser, and operating at a pressure, lower than that of said high pressure column pressure, of from about 40 to 150 psia;

(G) separating said first oxygen-enriched vapor fraction by rectification in said medium pressure column into a second nitrogen-rich vapor fraction and a second oxygen-enriched liquid fraction;

(H) recovering from about 20 to 60 percent of said second nitrogen-rich vapor fraction as medium pressure nitrogen gas at a pressure of from about 40 to 150 psia and a purity of at least 99 mole percent;

(I) condensing a portion of said second nitrogen-rich vapor fraction by indirect heat exchange with said second oxygen-enriched liquid fraction thereby producing a second nitrogen-rich liquid portion and a second oxygen-enriched vapor fraction;

(J) employing said second nitrogen-rich liquid portion as liquid reflux for said medium pressure column; and (K) removing from the process said second oxygen-enriched vapor fraction.

2. The process of claim 1 wherein said high pressure column is operating at a pressure of from about 90 to 200 psia.

3. The process of claim 1 wherein said high pressure column is operating at a pressure of from about 100 to 160 psia.

4. The process of claim 1 wherein said medium pressure column is operating at a pressure of from about 45 to 100 psia.

5. The process of claim 1 wherein said medium pressure column is operating at a pressure of from about 50 to 80 psia.

6. The process of claim 1 wherein a portion of said first nitrogen-rich liquid portion is recovered as product liquid nitrogen.

7. The process of claim 1 wherein a portion of said second nitrogen-rich liquid portion is recovered as product liquid nitrogen.

8. The process of claim 1 wherein up to about 5 percent of said first oxygen-enriched liquid fraction is introduced into said medium pressure column.

9. The process of claim 1 wherein said second oxygen-enriched vapor fraction is warmed and expanded prior to removal from the process.

10. The process of claim 1 wherein from about 10 to 30 percent of said cleaned cooled feed air is warmed, expanded and introduced into said medium pressure column as feed wherein it is separated into parts which make up said second nitrogen-rich vapor fraction and said second oxygen-enriched liquid fraction.

11. The process of claim 1 wherein from about 30 to 50 percent of said first nitrogen-rich vapor fraction in step (C) is recovered as high pressure nitrogen gas.

12. The process of claim 1 wherein from about 35 to 45 percent of said first nitrogen-rich vapor fraction in step (C) is recovered as high pressure nitrogen gas.

13. The process of claim 1 wherein from about 30 to 50 percent of said second nitrogen-rich vapor fraction in step (H) is recovered as medium pressure nitrogen gas.

14. The process of claim 1 wherein from about 35 to 45 percent of said second nitrogen-rich vapor fraction in step (H) is recovered as medium pressure nitrogen gas.

15. The process of claim 1 wherein at least some of the said second oxygen-enriched vapor fraction is recovered as product lower purity oxygen.

16. The process of claim 1 wherein from about 1 to 3 percent of the cleaned cooled feed air is condensed by indirect heat exchange with product or waste streams and introduced into either the high pressure or the medium pressure column.

17. The process of claim 1 wherein at least some of the first nitrogen-rich vapor fraction which is recovered as product nitrogen gas is expanded prior to recovery.

* * * * *